US009028219B2

(12) United States Patent
Clark et al.

(10) Patent No.: US 9,028,219 B2
(45) Date of Patent: May 12, 2015

(54) TURBOMACHINE BLADE

(75) Inventors: Daniel Clark, Derbyshire (GB); Jem Athing Rongong, Stockport (GB)

(73) Assignee: Rolls-Royce PLC (GB)

( * ) Notice: Subject to any disclaimer, the term of this patent is extended or adjusted under 35 U.S.C. 154(b) by 2154 days.

(21) Appl. No.: 12/105,576

(22) Filed: Apr. 18, 2008

(65) Prior Publication Data

US 2008/0273983 A1 Nov. 6, 2008

(30) Foreign Application Priority Data

May 1, 2007 (GB) ..... 0708377.7

(51) Int. Cl.

| | |
|---|---|
| ***F01D 5/14*** | (2006.01) |
| ***F04D 29/38*** | (2006.01) |
| ***F01D 21/04*** | (2006.01) |
| ***F04D 29/32*** | (2006.01) |

(52) U.S. Cl.

CPC ..... *F04D 29/388* (2013.01); *F01D 5/147* (2013.01); *F01D 21/045* (2013.01); *F04D 29/324* (2013.01); *F05D 2250/70* (2013.01); *F05D 2300/501* (2013.01); *F05D 2300/506* (2013.01)

(58) Field of Classification Search

CPC ..... F01D 5/147
USPC ..... 416/500, 229 A, 232, 233, 223 A
See application file for complete search history.

(56) References Cited

U.S. PATENT DOCUMENTS

| | | | | |
|---|---|---|---|---|
| 4,111,600 | A | 9/1978 | Rothman et al. | |
| 4,730,984 | A | 3/1988 | Ortolano | |
| 5,018,271 | A | 5/1991 | Bailey et al. | |
| 5,340,280 | A | 8/1994 | Schilling | |
| 5,439,354 | A | 8/1995 | Hansen et al. | |
| 5,490,746 | A | 2/1996 | Baker | |
| 6,467,168 | B2 | 10/2002 | Wallis | |
| 7,118,346 | B2 | 10/2006 | Read | |
| 8,016,561 | B2 | 9/2011 | Moniz et al. | |
| 2004/0018091 | A1 * | 1/2004 | Rongong et al. | 416/229 A |
| 2004/0253115 | A1 * | 12/2004 | Williams et al. | 416/229 R |
| 2005/0158171 | A1 | 7/2005 | Carper et al. | |
| 2006/0104818 | A1 * | 5/2006 | McMillan et al. | 416/232 |
| 2007/0092379 | A1 | 4/2007 | Coupe et al. | |
| 2008/0019838 | A1 | 1/2008 | Read et al. | |
| 2010/0239426 | A1 * | 9/2010 | Westergaard | 416/226 |

FOREIGN PATENT DOCUMENTS

| | | |
|---|---|---|
| EP | 0926312 A3 | 8/2000 |
| GB | 1323883 | 7/1973 |

(Continued)

OTHER PUBLICATIONS

FLS, Inc. JP 60228705 A Translation. United States Patent and Trademark Office. Washington D.C. Jun. 2011. pp. 1-9.*

*Primary Examiner* — Richard Edgar
(74) *Attorney, Agent, or Firm* — McCormick Paulding & Huber LLP

(57) ABSTRACT

A turbomachine including securing means that extend between the pressure wall and the suction surface and which includes an energy absorbing portion for absorbing energy after impact to the blade by a foreign object. The energy absorbing portion has a catch that provides the blade with an improved resistance to bursting.

6 Claims, 5 Drawing Sheets

(56) References Cited

FOREIGN PATENT DOCUMENTS

| | | | | |
|---|---|---|---|---|
| GB | 1539634 | | | 1/1979 |
| GB | 2401407 | | | 10/2004 |
| JP | 57-143103 | | | 4/1982 |
| JP | 57143103 | A | * | 9/1982 |
| JP | 60228705 | A | * | 11/1985 |
| JP | 01277603 | A | * | 11/1989 |
| WO | 2007048996 | | | 5/2007 |

* cited by examiner

TURBOMACHINE BLADE

CROSS REFERENCE TO RELATED APPLICATION

This application is entitled to the benefit of British Patent Application No. GB 0708377.7 filed on May 1, 2007.

FIELD OF THE INVENTION

The present invention relates to a turbomachine blade, for example, a compressor blade for a gas turbine engine and in particular to a fan blade for a gas turbine engine.

BACKGROUND OF THE INVENTION

A turbofan gas turbine engine 10, as shown schematically in FIG. 1, comprises in axial flow series an inlet 12, a fan section 14, a compressor section 16, a combustion section 18, a turbine section 20 and an exhaust 22. The fan section 14 comprises a fan rotor 24 carrying a plurality of equi-angularly-spaced radially outwardly extending fan blades 26. A fan casing 28 that defines a fan duct 30 surrounds the fan blades 26 and the fan duct 30 has an outlet 32. The fan casing 28 is supported from a core engine casing 34 by a plurality of radially extending fan outlet guide vanes 36.

The turbine section 20 comprises one or more turbine stages to drive the compressor section 18 via one or more shafts (not shown). The turbine section 20 also comprises one or more turbine stages to drive the fan rotor 24 of the fan section 14 via a shaft (not shown).

One known wide chord fan blade is disclosed in US2004/0018091 to the present applicant and is depicted in FIGS. 2 and 3. The blade 26 comprises a root portion 40 and an aerofoil portion 42. The root portion 40 comprises a dovetail root, a firtree root, or other suitably shaped root for fitting in a correspondingly shaped slot in the fan rotor, or for mounting to a disk to form a blisk by linear friction welding or other appropriate method. The aerofoil portion 42 has a leading edge 44, a trailing edge 46 and a tip 48. The aerofoil portion 42 comprises a concave wall 50, which extends from the leading edge 44 to the trailing edge 46, and a convex wall 52 that extends from the leading edge 44 to the trailing edge 46. The concave and convex walls 50 and 52 respectively comprise a metal for example a titanium alloy. The aerofoil portion 42 has an interior surface 54 and at least a portion, preferably the whole, of the hollow interior 54 of the aerofoil portion 42 is filled with a vibration damping system 56.

The damping material 56 is a relatively low shear modulus material having viscoelasticity. Viscoelasticity is a property of a solid or liquid which when deformed exhibits both viscous and elastic behaviour through the simultaneous dissipation and storage of mechanical energy. Suitable materials comprise a polymer blend, a structural epoxy resin and liquid crystal siloxane polymer.

One particular and preferred polymer blend comprises, per 100 grams: 62.6% Bisphenol A-Epochlorohydrin (Epophen resin EL5 available from Borden Chemicals, UK); 17.2 grams Amine hardener (Laromin C260 available from Bayer, Germany); 20.2 grams of branched polyurethane (Desmocap 11 available from Bayer, Germany). This polymer blend is then mixed in a mass ratio of 1:1 with a structural epoxy resin, preferably Bisphenol A-Epochlorohydrin mixed with an amine-terminated polymer (e.g. Adhesive 2216 available from 3M).

A fan is susceptible to Foreign Object Damage, or FOD. Composite blades are not as robust as metal blades but offer advantages in terms of reduced mass. Where a hollow blade is provided there is a risk that the blade may burst when impacted by a large object. The use of a viscoelastic filler or core offers damping but also offers a secondary advantage in that the sides of the blade are held together to resist bursting, particularly busting at the trailing edge tip. Blade robustness may be improved through the provision of an internal warren truss arrangement as shown in FIG. 4 where metal girders 60 extend between the concave face 50 and convex face 52 of the aerofoil. The viscoelastic damping material extends around the girders 60

The girders inhibit bursting of the blade upon impact by foreign objects but provide a pathway for the transmittal of vibrational loads through the damping material which can render such damping material obsolete.

SUMMARY OF THE INVENTION

Accordingly, the present invention seeks to provide a novel turbomachine blade that addresses, and preferably overcomes, the above mentioned problems.

According to the invention, there is provided a turbomachine blade comprising a root portion and an aerofoil portion, the aerofoil portion having a leading edge, a trailing edge, a wall for forming a pressure surface extending from the leading edge to the trailing edge and wall for forming a suction wall extending from the leading edge to the trailing edge, wherein the aerofoil portion includes securing means extending between the pressure wall and the suction surface, wherein the securing means and comprising a first extension extending from the suction wall and a second extension extending from the pressure wall, the securing means having an energy absorbing portion comprising a first catch element provided on the first extension and a second catch element provided on the second extension and wherein the first catch element is arranged to engage with the second catch element for absorbing energy after impact to the blade by the foreign object.

Preferably, the pressure wall is concave. The suction wall may be convex.

Preferably, the first catch element and the second catch element are separated from each other by a volume containing a viscoelastic damper.

DETAILED DESCRIPTION OF THE PREFERRED EMBODIMENTS

Figure 1:
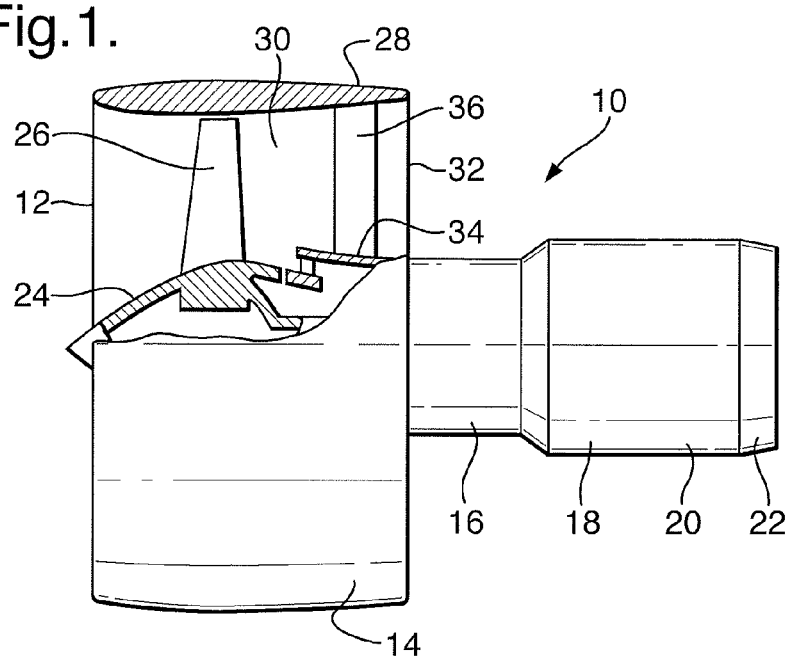
FIG. 1 depicts a first embodiment of a blade provided by the present invention in operational condition.
Figure 2:
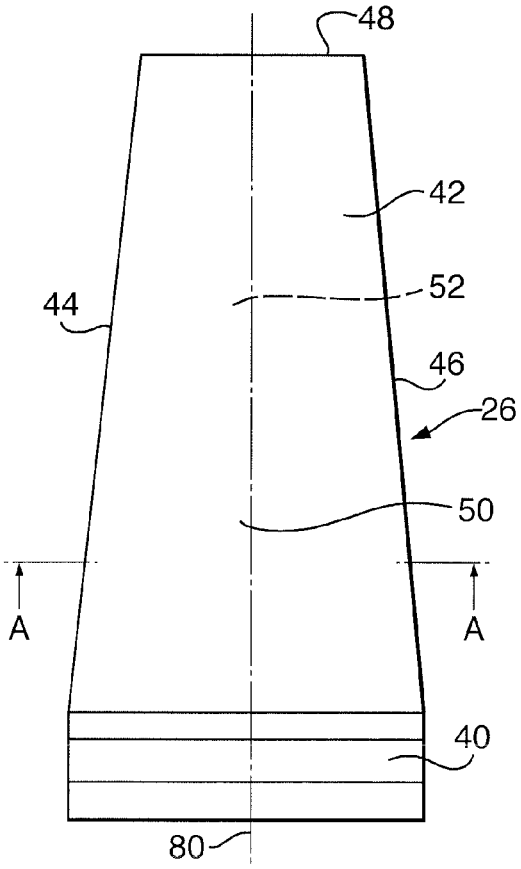
Fig.2. Prior Art
FIG. 2 is a simplified schematic illustration of a known wide chord saw blade.
Figure 3:
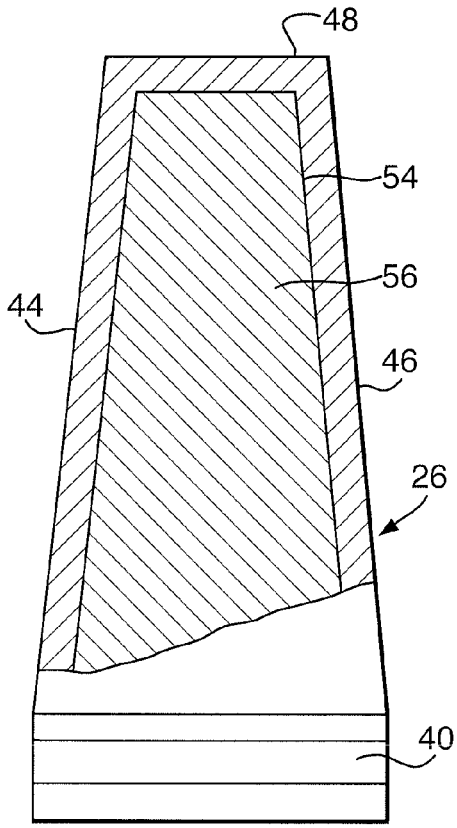
Fig.3. Prior Art
FIG. 3 is a second schematic view of the fan blade of FIG. 2.
Figure 4:
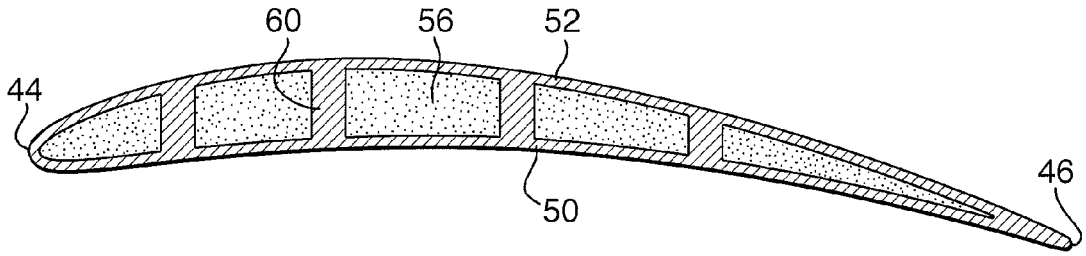
Fig.4. Prior Art
FIG. 4 is a simplified schematic illustration, in section, of a known fan blade having an internal warner truss.
Figure 5:
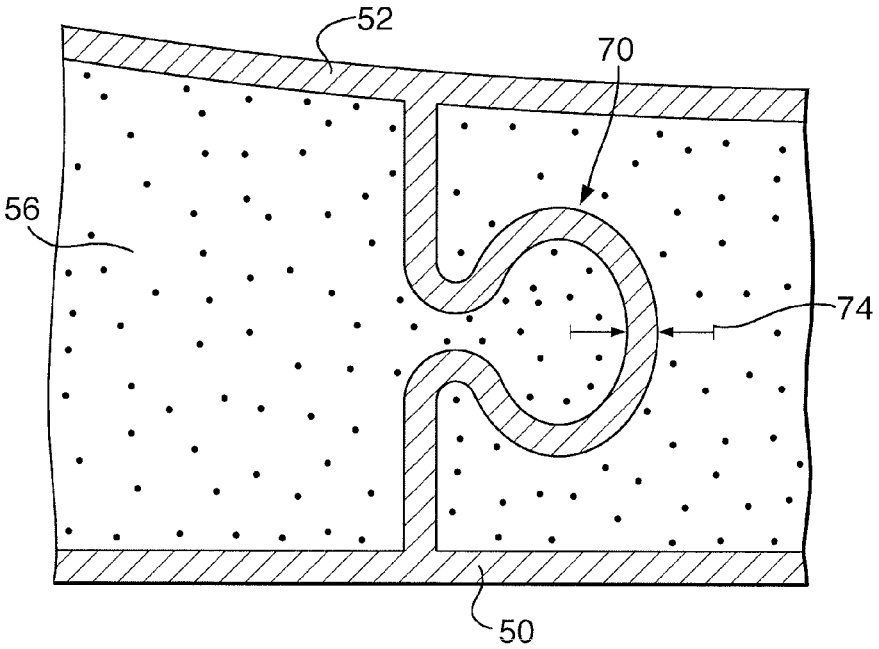
FIG. 5 depicts a cross-sectional view of a blade having an internal spring.

A blade as shown in FIG. 5 has an internal spring section 70 that extends between the concave face 50 and convex face 52. The spring is non-linear and enables vibrations at low strain levels to be accommodated in the viscoelastic damping material 56. At least one spring element is provided, but where multiple spring elements are present these are provided at equal spacing across the span of the aerofoil that extends between the leading edge 44 and the trailing edge 46 and may be tessellated or interlinked. The springs are aligned with a length that extends generally parallel to the midline 80 of the blade and the majority of the springs are positioned in a region that is towards the tip end as this is the region most prone to failure in the case of soft body foreign object damage.

The damping material 57 is a relatively low shear modulus material having viscoelasticity. Viscoelasticity is a property of a solid or liquid which when deformed exhibits both viscous and elastic behaviour through the simultaneous dissipation and storage of mechanical energy. Suitable materials for the damping layer 57 comprise a polymer blend, a structural epoxy resin and liquid crystal siloxane polymer.

One particular and preferred polymer blend comprises, per 100 grams: 62.6% Bisphenol A-Epochlorohydrin (Epophen resin EL5 available from Borden Chemicals, UK); 17.2 grams Amine hardener (Laromin C260 available from Bayer, Germany); 20.2 grams of branched polyurethane (Desmocap 11 available from Bayer, Germany). This polymer blend is then mixed in a mass ratio of 1:1 with a structural epoxy resin, preferably Bisphenol A-Epochlorohydrin mixed with an amine-terminated polymer (e.g. Adhesive 2216 available from 3M).

It is desirable for the damping material to have a modulus of elasticity in the range 0.5-100 MPa.

The viscoelastic material allows the component to withstand high levels of vibration. The spring element 70 is formed integrally with the convex and concave surfaces and has a thickness 74 of about between 30 □m to 1 mm for an aero-fan blade.

The spring element is formed during manufacture of the blade by powder fed laser deposition where a laser is directed at surface of the blade with sufficient power and focus to form a melt pool thereon into which a powder is supplied and melted. The laser translates across the surface and consequently the melt pool also translates across the surface. As the laser moves from an area to which powder has been added the added powder solidifies to form a deposit having a height. By making repeated passes over an area it is possible to add layers to previously added deposits thereby increasing the overall height of the deposit.

As an alternative the springs may be formed using HIPping using an internal structure or a leachable or etchable support media.

Figure 6A:
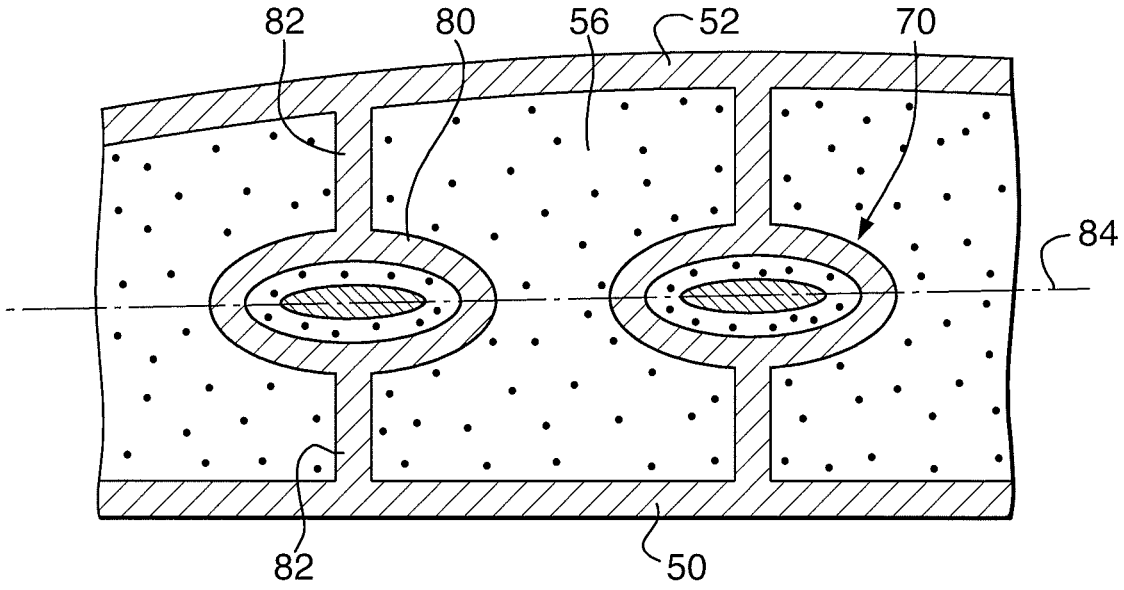
FIG. 6*a* schematically depicts a cross-sectional view of the blade of FIG. 5 in normal use.
Figure 6B:
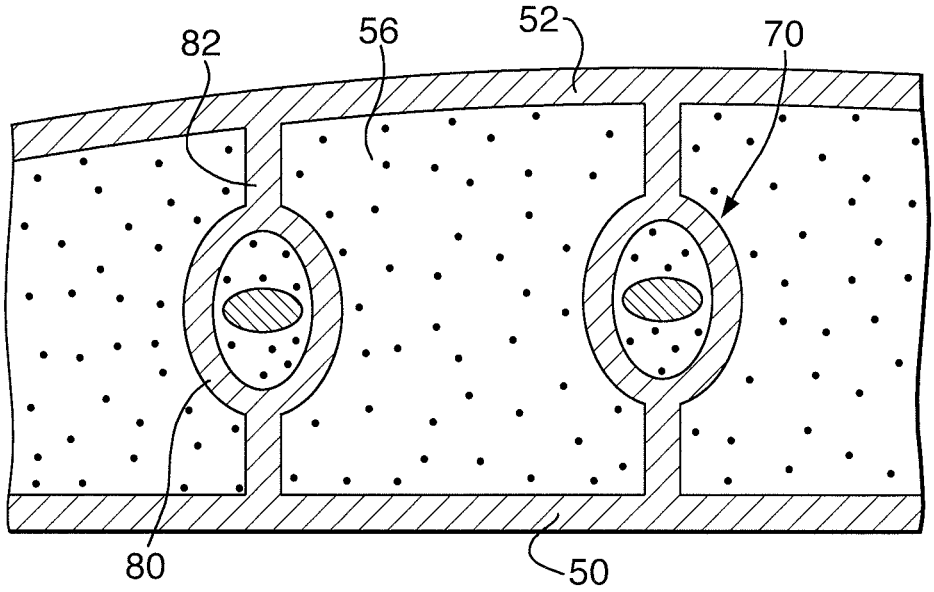
FIG. 6*b* depicts a cross-sectional view of the blade of FIG. 5 following an impact when the distance between the pressure and suction flanks increase significantly.

The spring may have other forms as embodied in FIG. 6. The spring in this embodiment comprises a tubular element, which is secured between the convex face and concave face by flanges 82. The tube is oval in cross-section with the major axis 84 of the cross section lying substantially parallel to the concave and convex surfaces. Each flange is relatively thin to minimise the transmittal of vibrations.

The tubes preferably run generally radially between the root and the tip though both the length and major axis can be orientated in other directions depending on the damping requirements and/or requirements on structural support. FIG. 6(*a*) shows the arrangement in normal use.

Upon impact of foreign objects, the blade may burst or deform with drastic changes to the cross-sectional width of the blade, i.e., the distance between the pressure flank and suction flank increases significantly as depicted in FIG. 6(*b*). Upon such an impact the tubular member is stretched to absorb energy and retain the convex and concave surfaces preventing their separation.

In an alternative aspect to the invention, the spring element is replaced with catches. The catches are not connected in normal use and consequently the vibrational transmit path is minimised.

Figure 7A:
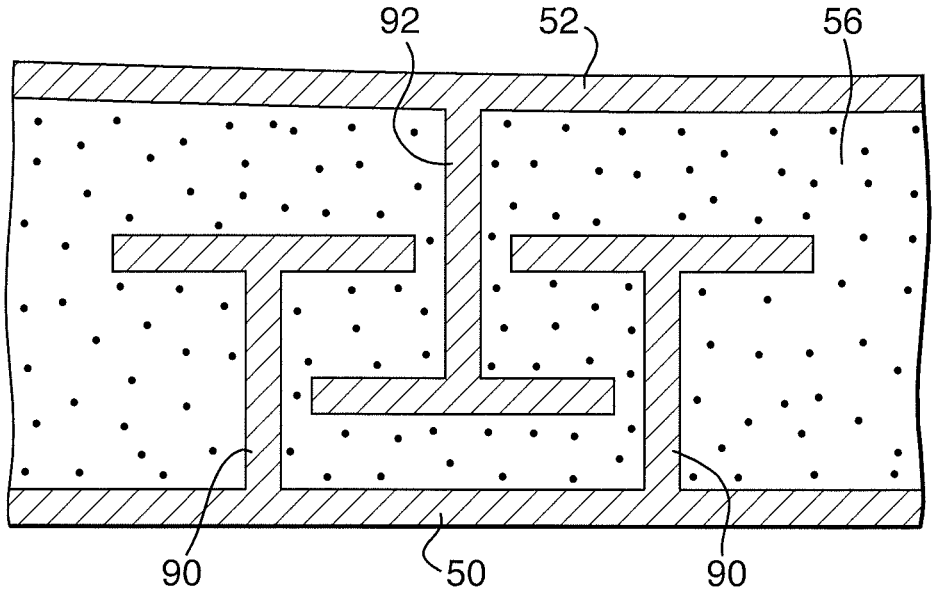
FIG. 7*a* depicts a first embodiment of a blade provided by the present invention in operation.
Figure 7B:
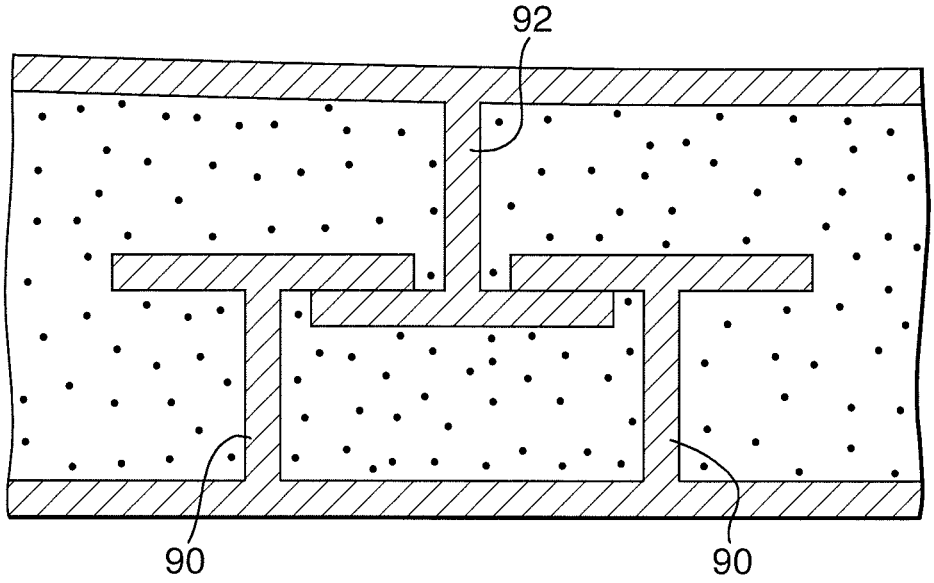
FIG. 7*b* is a simplified illustration of the blade of FIG. 7*a* after impact from a foreign object.

FIG. 7(*a*) depicts a first embodiment of a blade provided by the present invention in operational condition. The inside face of the concave surface is provided with a series of integral "T" arms 90 that are interleaved with a series of "T" arms 92 on the inside face of the convex surface. The top bars of the "T" arms overlap the top bars of the interleaved bars such that the underside faces of each bar opposes an underside face of an adjacent, interleaved bar.

FIG. 7(*b*) is a simplified illustration of the blade of FIG. 7(*a*) after impact from a foreign object. Upon failure of the blade because of impact, the convex face and concave face move apart and the underside of the "T" arms engage to retain the convex and concave surfaces and prevent their separation.

The viscoelastic filler is added by pouring, under a slight positive pressure, the material into the internal cavity of the blade.

Figure 8:
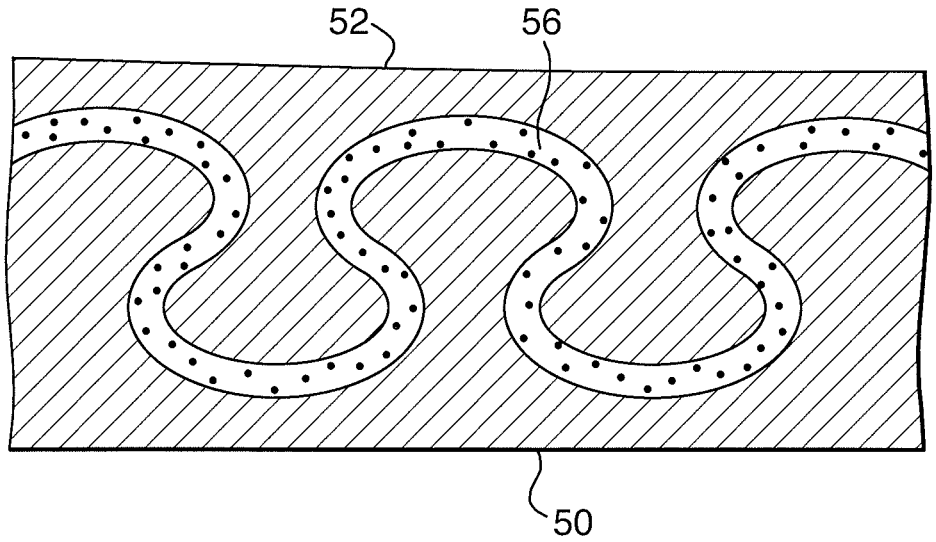
FIG. 8 depicts a cross-sectional view of a blade in accordance with a second embodiment of the invention.

In an alternative embodiment of the present invention shown in FIG. 8, the "T" arms are replaced with interlocking elongate structures with a "mushroom" form cross-section. The head and stalk of opposing "mushrooms" are shaped to provide a constant thickness of viscoelastic damper between them.

The thickness of damping material is related to the damping modulus and has a thickness of between 500 and 1000 μm.

Although the invention has been described with reference to a fan blade 26, it is equally applicable to a compressor blade.

Although the invention has been described with reference to titanium alloy blades, it is equally applicable to other metal alloy, metal or intermetallic blades.

What is claimed is:

1. A turbomachine blade comprising a root portion and an aerofoil portion, the aerofoil portion having a leading edge, a trailing edge, a wall for forming a pressure surface extending from the leading edge to the trailing edge and wall for forming a suction wall extending from the leading edge to the trailing edge, wherein the aerofoil portion includes a first extension extending from the suction wall towards the pressure wall and a second extension extending from the pressure wall towards the suction wall, wherein a first catch element is provided on the first extension and a second catch element is provided on the second extension wherein the first catch element is arranged to engage with the second catch element and absorb energy after impact to the blade by the foreign object and the first catch element and the second catch element are separated from each other by a volume containing a viscoelastic damper.

2. A turbomachine blade according to claim 1, wherein the pressure wall is concave.

3. A turbomachine blade according to claim 1, wherein the suction wall is convex.

4. A turbomachine blade according to claim 1, wherein a cross-section through the first catch element and first extension has a "T" shape.

5. A turbomachine blade according to claim 1, wherein the first catch element and first extension are arranged with a mushroom form cross-section.

6. A turbomachine blade according to claim 1, wherein the thickness of damping material between the first catch element and the second catch element is between 500 and 1000μm.

* * * * *